United States Patent [19]

Hayashi et al.

[11] 4,362,700

[45] Dec. 7, 1982

[54] CATALYTIC CONVERTER

[75] Inventors: Tadayoshi Hayashi, Fujimi; Ikuo Kajitani, Hanno; Katsusuke Ueno; Yutaka Noritake, both of Kawagoe, all of Japan

[73] Assignee: Honda Giken Kogyo Kabushiki Kaisha, Tokyo, Japan

[21] Appl. No.: 242,286

[22] Filed: Mar. 10, 1981

[30] Foreign Application Priority Data

Mar. 12, 1980 [JP] Japan ..... 55-30349

[51] Int. Cl.[3] ..... F01N 3/10

[52] U.S. Cl. ..... 422/179; 60/299; 60/302; 422/180

[58] Field of Search ..... 422/177, 179, 180; 60/299–302

[56] References Cited

U.S. PATENT DOCUMENTS

| | | | |
|---|---|---|---|
| 3,854,888 | 12/1974 | Frietzsche et al. | 422/180 X |
| 3,963,445 | 6/1976 | Koyama et al. | 422/179 |
| 3,966,419 | 6/1976 | Bloomfield | 422/179 |
| 4,043,761 | 8/1977 | Gaysert et al. | 422/179 |
| 4,101,280 | 7/1978 | Frietzsche et al. | 422/180 |
| 4,143,117 | 3/1979 | Gaysert | 422/179 |
| 4,161,509 | 7/1979 | Nowak | 422/179 |
| 4,180,544 | 12/1979 | Santiago | 60/299 X |
| 4,248,833 | 2/1981 | Aoyama | 422/179 |
| 4,278,717 | 7/1981 | Aoyama | 422/179 X |
| 4,279,864 | 7/1981 | Nara et al. | 422/180 X |
| 4,328,187 | 5/1982 | Musall et al. | 422/179 |

FOREIGN PATENT DOCUMENTS

| | | | |
|---|---|---|---|
| 2525660 | 12/1975 | Fed. Rep. of Germany | 422/179 |

*Primary Examiner*—Richard L. Chiesa

*Attorney, Agent, or Firm*—Armstrong, Nikaido, Marmelstein & Kubovcik

[57] ABSTRACT

A catalytic converter includes ring-shaped cushion members of differing bulk densities at each axial end of a catalyzer carrier, a first cushion member which is supported by a casing of the converter being of lesser bulk density than that of a second cushion member which is interposed between said first cushion member and the adjacent axial end of said catalyzer carrier.

5 Claims, 8 Drawing Figures

CATALYTIC CONVERTER

FIELD OF THE INVENTION

This invention relates to a catalytic converter, and more particularly relates to the manner in which a catalyzer carrier is supported within a casing of the catalytic converter. While not limited thereto, the catalytic converter of the present invention finds particular application in an automobile or motorcycle for converting objectionable or noxious exhaust products of the engine into a more acceptable form.

BACKGROUND OF THE INVENTION

Catalytic converters are known in the art in which a catalyzer carrier is supported within a casing of the converter by ring-shaped cushion members, the respective cushion members being supported on internal annular flanges of the casing at the opposite axial ends of the catalyzer carrier. Typically, the cushion members have a bulk density of 1.10 gr/c.c. and are formed of a material which is resistive to the hostile atmosphere of the catalytic converter and to compaction under the thermal stresses induced in the cushion members during operation of the catalytic converter.

To protect the cushion members from direct contact with the catalyzer carrier, a solid metal spacer ring is interposed between the respective cushion members and the adjacent end of the catalyzer carrier, the respective rings seating directly on the adjacent end faces of the catalyzer carrier.

While such a structure is satisfactory in protecting the cushion members from thermal destruction, it suffers the disadvantage that localized compressive stresses are exerted on the axial ends of the catalyzer carrier, which result in crumbling, flaking or breakage of the ends of the catalyzer carrier and the ultimate rapid breakdown thereof. The catalyzer carrier itself typically is formed by extrusion molding and sintering of the catalyzer material, with a consequence that the end faces of the catalyzer carrier are not truly planar, but are undulating and uneven, and deviate randomly from a truly planar condition, this prohibiting accurate face-to-face seating of the spacer rings on the end faces of the catalyzer carrier, unless the end faces of the catalyzer carrier are ground and polished to planar form with the expenses attendant thereon.

OBJECT OF THE INVENTION

It is an object of this invention to overcome the problem discussed above in a simple and inexpensive manner, which does not require form finishing of the end faces of the catalyzer carrier.

INVENTIVE CONCEPT

According to the present invention, the problem discussed above is mitigated or eliminated in its entirety by forming the metal spacer rings for them to be second cushion members of a density higher than that of the known first cushion members, whereby the said second cushion members can closely adapt to the undulating and uneven radial end faces of the catalyzer carrier, and distribute the pressures exerted thereon evenly over the entire area of the respective end faces in the substantial absence of any localized high pressure areas.

Preferably, the respective first and second cushion members are formed by fine stainless steel wire of 0.1 mm outside diameter which has been woven or knitted into a cloth material, or formed into a felt like scrim material, or a combination of such materials, the first cushion members having a bulk density of about $1.05 \pm 0.15$ gr/c.c. before setting into position which increases to a bulk density of $1.15 \pm 0.15$ gr/c.c. when under compression, and, the second cushion members having a bulk density of $3 \pm 0.5$ gr/c.c., in order that the second cushion members be substantially more resistive to compression than the first cushion members, while still producing an equalization of pressure over the entire associated end face of the catalytic carrier.

Additionally, in order further to enhance dissipation of heat from the second cushion members, preferably the second cushion members are formed to be of L-shaped transverse cross section for them to include a radial flange engaged between the end of the catalyzer carrier and the first cushion member, and a radially outer axial flange engaged with inner periphery of the casing of the converter.

DESCRIPTION OF THE DRAWINGS

The invention will now be described with reference to the accompanying drawings, in which.

PRIOR ART EMBODIMENT

Figure 1:
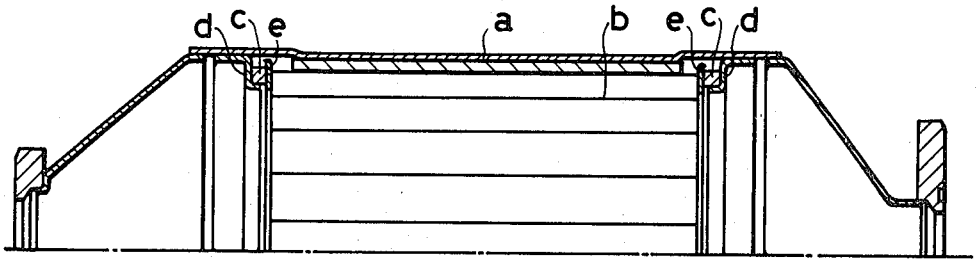
FIG. 1 is a longitudinal cross-section through a catalytic converter known from the prior art.
Figure 2:
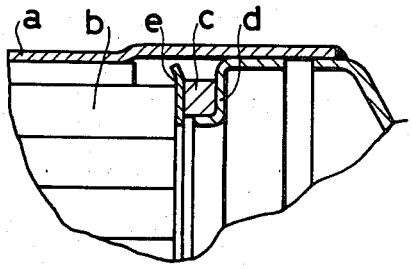
PRIOR ART FIG. 2
FIG. 2 is an enlarged illustration of a portion only of FIG. 1.

Referring now to FIGS. 1 and 2, there is shown a catalytic converter as known in the art, the catalytic converter including an outer casing a within which is supported a catalyzer carrier b, the respective ends of the catalyzer carrier being positioned in a direction longitudinally of the catalyzer carrier by cushion members c supported by internal annular flanges of the casing a.

Interposed between the ends of the catalyzer carrier b and the cushion members c are metal rings e, the metal rings serving to protect the cushion members from thermal destruction by the catalyzer carrier b.

The metal rings e are inherently rigid, and as such, cannot conform to the end faces of the catalyzer carrier, the end faces of the catalyzer carrier being other than truly planar by virtue of the manner in which the catalyzer carrier is manufactured. In particular, the catalyzer carrier is manufactured by extruding the catalyzer material and then sintering the material, the extrusion and sintering steps resulting in end faces of the catalyzer carrier which are other than truly planar. Those end faces may be of undulating form, the end faces deviating randomly with respect to a plane perpendicular to the longitudinal axis of the catalyzer carrier.

As a consequence of the end faces of the catalyzer carrier being other than truly planar, the metal rings e cannot seat on the end faces in face contact therewith over the entire surface area of the end faces, and, as a consequence, stresses appear in the catalyzer carrier at the high points of the end faces. Being formed of a relatively friable material, the catalyzer carrier tends to crumble or break at the points of high pressure, this resulting in a rapid breakdown of the catalyzer carrier.

This problem could be overcome by grinding and polishing the end faces of the catalyzer carrier, but, such a machining operation is totally impractical having regard to the expenses attendant thereon.

DESCRIPTION OF THE PREFERRED EMBODIMENTS

Figure 3:
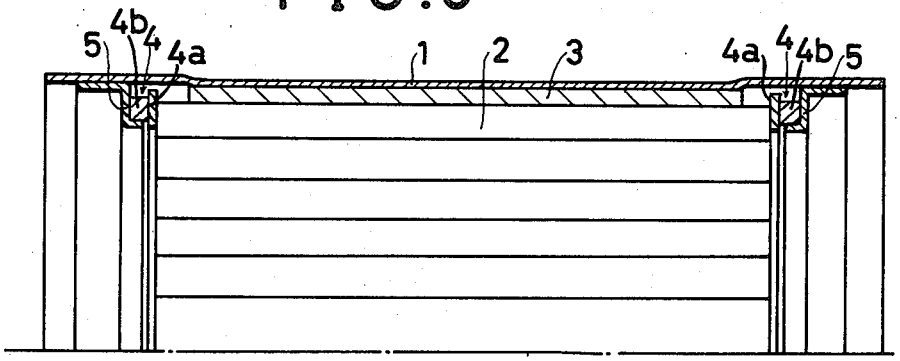
PRIOR ART FIG. 3
FIG. 3 is a longitudinal cross-section through a catalytic converter according to the present invention.
Figure 4:
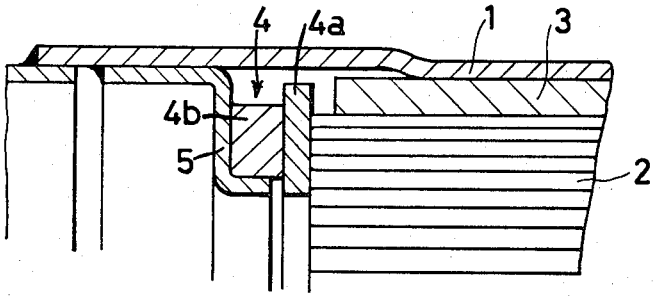
FIG. 4 is an enlarged illustration of a portion only of the catalytic converter of FIG. 3.

Referring now to FIG. 3, there is shown a catalytic converter including a casing 1 within which a catalyzer carrier 2 is positioned, the catalyzer carrier 2 being supported within the casing 1 by a tubular cushion member 3.

The catalyzer carrier 2 serves to so guide exhaust gas as to pass therethrough, and the lefthand end thereof in the drawings is on the upstream side of the exhaust gas current and the right-hand end thereof in the drawings is on the downstream side of the same.

At each axial end of the catalyzer carrier 2 there is provided a cushion assembly 4 comprised by a first cushion member **4*b* which is supported and located by internal annular flanges 5 carried by the casing 1, and, by a second cushion member 4*a* which is interposed between the respective first cushion members 4*b* and the adjacent axial end of the catalyzer carrier 2**.

The second cushion members **4*a* differ entirely in their characteristics from the rigid and incompressible metal rings e of the prior art construction, the second cushion members 4*a* each being resiliently compressible, and having a resistance to compression which is greater than that of the first cushion members 4*b***.

According to the present invention, the respective first and second cushion members **4*b* and 4*a*** are formed from fine stainless steel wire having an outside diameter of about 0.1 mm, the stainless steel wire having been either woven into a mesh, or knitted into a fabric, or, formed into a felt like scrim in any manner well known in the art. The respective cushion members may be formed of one of those materials alone, or, from a combination of those materials, such as an annulus of felt-like scrim covered with a wrapping of woven or knitted mesh material. Either prior to the formation of the material into the respective cushion members, or subsequent thereto, the material is compressed in order to bring the bulk density of the first cushion members to $1.05 \pm 0.15$ gr/c.c., and to bring the bulk density of the second cushion members to $3 \pm 0.5$ gr/c.c.

During the assembly of the catalytic converter, the first cushion members become compressed to a bulk density of $1.15 \pm 0.15$ gr/c.c., there being little further compression of the second cushion members, whose bulk density remains closely within the range $3 \pm 0.5$ gr/c.c., in that the second cushion members are substantially more resistive to further compression and increase of their bulk density than are the first cushion members.

In direct opposition to the rigid and incompressible metal rings e of the prior art construction, the second cushion members of the present invention inherently are flexible to a limited extent and compressible to a limited extent, with a consequence that the second cushion members of the present invention seat closely on the irregular end surface of the catalyzer carrier and distribute the compressive force over the entire face area of the end of the catalyzer carrier in the substantial absence of any increase in compressive stress at any point along the end faces. By equalizing the compressive stresses, the possibility of crumbling or breakage of the catalyzer carrier is mitigated or eliminated, thus considerably extending the useful life thereof.

Because of such a construction that the second cushion member **4*a* is comparatively high in density and the first cushion member 4*b* is comparatively low in density, the second cushion member 4*a* is small in its own deformation by heat and can serve to lower the thermal conduction therethrough from the catalyzer carrier 2 to the first cushion member 4*b* and consequently maintain the cushion function of the first cushion member 4*b* in a good condition for a long period of time, and thus an overall excellent cushion property of the cushion assembly 4 can be given chiefly by the first cushion member 4*b* and additionally the second cushion member 4*a* can produce no increase in local surface pressure at its contact surface with the catalyzer carrier 2 and thus can prevent the catalyzer carrier 2** from damaging.

Figure 5:
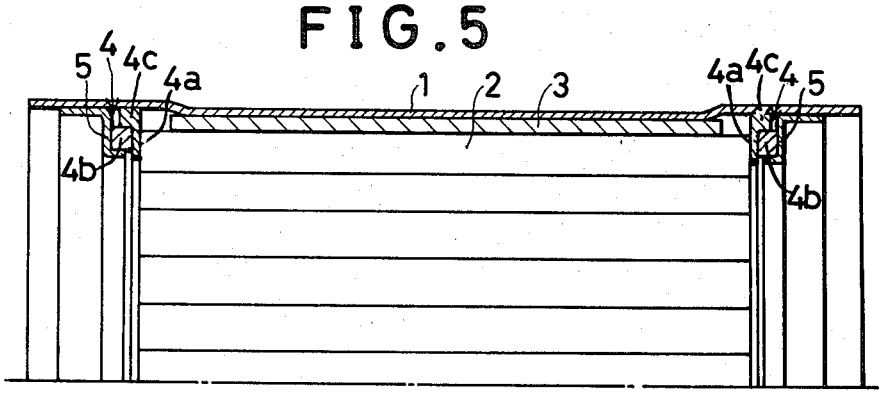
FIG. 5 is a longitudinal cross-section through an alternative form of catalytic converter according to the present invention.

Referring now to FIG. 5, the second cushion member **4*a* is formed to have an axial flange 4*c* at the radially outer periphery thereof, the respective flanges 4*c* being positioned for them to extend over the first cushion members 4*b*, thus enhancing the dissipation of heat from both of the cushion members 4*b* and 4*a* to the converter casing 1**.

Figure 6:
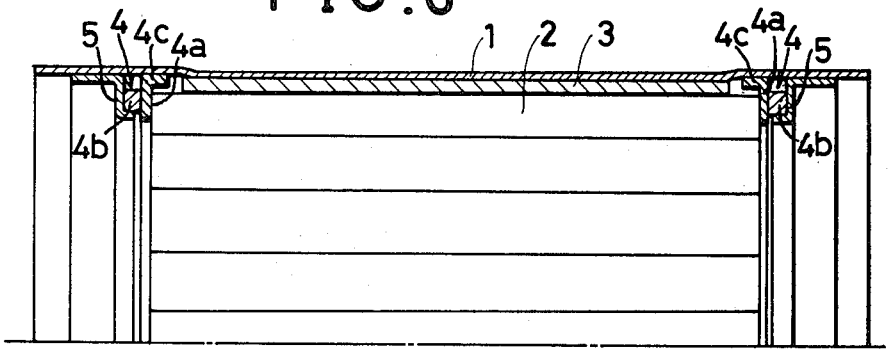
FIG. 6 is a longitudinal cross-section through another form of catalytic converter according to the present invention.

In FIG. 6, the second cushion members **4*a* each include an axial flange 4*c* which extends away from the first cushion members 4*b*, the flanges 4*c* again being provided for the purpose of dissipation of heat to the converter casing 1**.

Figure 7:
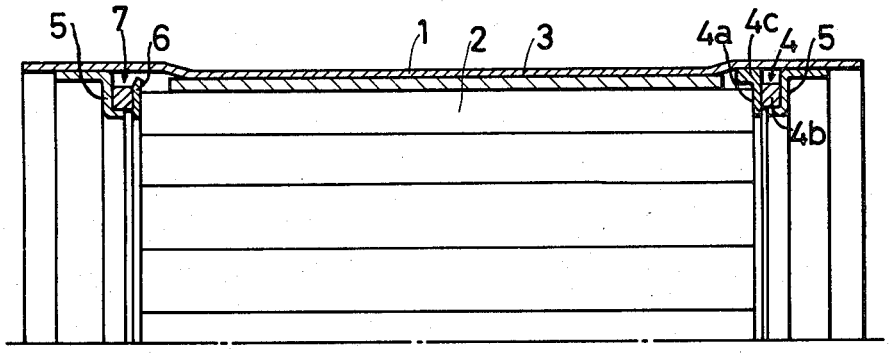
FIG. 7 is a longitudinal cross-section through another alternative form of catalytic converter according to the present invention; and, FIG. 8 is a longitudinal cross-section through still another form of catalytic converter according to the present invention.

Referring now to FIG. 7, it is so arranged that, only on the downstream side, that is, at the righthand end of the catalyzer carrier 2, the cushion assembly 4 is composed of the first cushion member **4*b* and the second cushion member 4*a*. Namely, this is to cope with such a circumstance that, under an abnormal condition of the engine, a reaction heat of the catalyzer carrier 2 becomes extremely high and thus the temperature of the catalyzer carrier 2 becomes high especially on the downstream side. In this case, on the upstream side, a conventional metal ring 6 is interposed between the conventional cushion member 7 which is usually 1.10 gr/c.c. in bulk density and the carrier 2** in almost the same manner as in the prior art construction.

Figure 8:
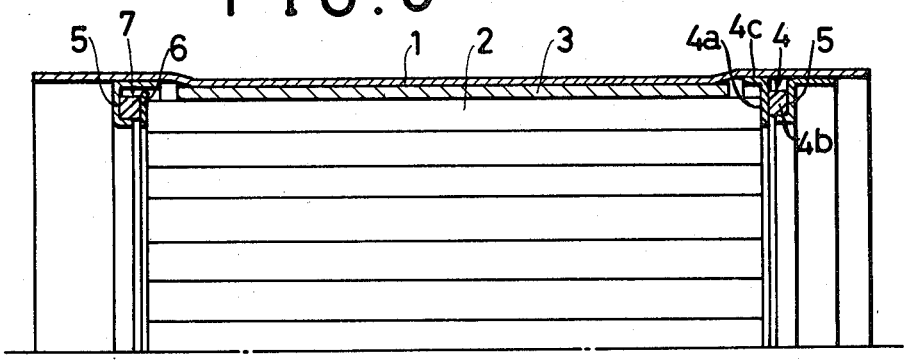

In FIG. 8 which is generally similar to that shown in FIG. 7, the annular flange 5 on the upstream side is bent inwards to be channel-shaped in section and is fixed to the converter casing 1, so that the cushion member 7 is arranged to be embraced by the same.

While preferred embodiments of the invention have been described with reference to the accompanying drawings, it will be understood that various modifications may be made in the structures disclosed without departing from the scope of the appended claims.

What we claim is:

1. In a catalytic converter including a casing having an inner circumferential surface, a catalyzer carrier located within the casing and having opposite ends and end edges, support members located within the casing at the respective ends of the catalyzer carrier, annular metal rings engaged with the respective ends of the catalyzer carrier, and an annular cushion member supported by each support member and compressively engaged by the adjacent annular metal ring, the improvement comprising:

at least one of said annular metal rings being comprised by a second cushion member having a bulk density which is higher than that of said first mentioned cushion member;

said second cushion member being L-shaped in transverse cross-section including a radial flange engaged between said catalyzer carrier and said first cushion member, and a radially outer axial flange engaged with said inner surface of said casing and having an inner periphery sized so as to form a gap between said end edge of said catalyzer carrier and said inner periphery of said axial flange.

2. The catalytic converter according to claim 1, in which each of said cushion members is a fabricated body of stainless steel wire having a diameter of about 0.1 mm, said first cushion members having a bulk density of 1.05±0.15 gr/c.c. before incorporation into said converter and a bulk density of 1.15±0.15 gr/c.c. upon compression, said second cushion member having a bulk density of 3±0.5 gr/c.c.

3. The catalytic converter according to claim 2, in which the material comprised by said stainless steel wire and which forms said first and second cushion members is selected from the group comprised by woven mesh material, knitted mesh material, and felted scrim material.

4. The catalytic converter according to claim 3, in which the material comprised by said stainless steel wire and which forms said first and second cushion members is comprised by a combination of materials selected from the group comprised by woven mesh material, knitted mesh material, and felted scrim material.

5. The catalytic converter according to claim 1 wherein said first cushion member has an outer peripheral surface sized so as to form a gap between said inner surface of said casing and said outer peripheral surface of said first cushion member.

* * * * *